United States Patent [19]

Wu

[11] Patent Number: 4,811,978

[45] Date of Patent: Mar. 14, 1989

[54] SIMPLIFIED SEALING STRIP

[76] Inventor: Don L. Wu, 57, Lane 7, Chung Chwan Road, Keelung, Taiwan

[21] Appl. No.: 183,064

[22] Filed: Apr. 19, 1988

[51] Int. Cl.[4] ..... B65D 33/34

[52] U.S. Cl. ..... 292/323

[58] Field of Search ..... 292/29, 193, 252, 307, 292/323, 355

[56] References Cited

U.S. PATENT DOCUMENTS

| | | | |
|---|---|---|---|
| 2,845,296 | 7/1958 | Stegmaier | 292/323 |
| 4,049,303 | 9/1977 | Irwin et al. | 292/307 R |
| 4,747,631 | 5/1988 | Loynes et al. | 292/307 R |

FOREIGN PATENT DOCUMENTS

| | | | |
|---|---|---|---|
| 848020 | 9/1952 | Fed. Rep. of Germany | 292/355 |

*Primary Examiner*—Richard E. Moore

*Attorney, Agent, or Firm*—Notaro & Michalos

[57] ABSTRACT

A simplified abuse preventing sealing strip means, which includes: a U-shaped strip or a straight strip which can be bent into a U-shaped form having toothed-edges or rows of consecutive slots, a sealing block which allows the two legs of the U-shaped strip to be inserted in but stops or brakes it from pulling out in the reversal direction. When the said sealing strip means is applied to a container which needs frequent opening and resealing for abuse prevention, such as the coin collecting box for a bus, the same container can not be opened unless the sealing strip is destroyed; this sealing strip means possesses simple in structure, convenient in use, low application cost, and sure abuse prevention etc. advantages.

1 Claim, 4 Drawing Sheets

SIMPLIFIED SEALING STRIP

BACKGROUND OF THE INVENTION

Present invention relates to a simplified sealing strip which is used to seal a container for the insurance of this container has not yet been opened by an unauthorized person.

Since ordinary locks can be easily opened and relocked by an unauthorized person without detected afterward, therefore, in order to avoid abuse, some containers, such as coin collecting box for bus, taximeter for cab use etc, are not sealed normally by a ordinary lock.

Though the above said containers or instrument are not sealed by an ordinary lock, but they are sealed by traditional sealing devices which include: Lead seals, they are used to seal the taximeter of a cab etc; paper sealing strips with offical sealing stamps, for simplicity they are called paper sealing strips, and they are widly used by court to seal houses or properties involved in law suit cases. Articles sealed by this traditional sealing method are characterized that unless these sealing means are destroyed, they could not be opened, therefore, once when they are opened by an unauthorized person the sealing means will become destroyed at the same time, since this sealing means can hardly be restored to its original condition, consequently, the sealing status can be easily detected.

In the traditional lead seal method, a steel wire is used to tighten the respective locking rings on the two doors of the article to be sealed, then a lead piece with a special official mark is pressed or casted on for fastening the two ends of the said steel wire. This method is widely used to seal taximeter of a cab, or other instrumental meters for public acknowledgment.

The above said lead seal method is rarely adopted to seal articles which need frequent open and reseal, such as the coin collecting box for a bus etc, because there exists some shortcomings as follows:

1. The cost of the lead seal device is comparatively higher, and;
2. When the sealed article is opened, it's lead seal device will be completly destroyed, therefore, new lead seal device should be used for reseal, as to an article which needs frequent open and seal, such as the coin collecting box for a bus, the sealing cost will be increased therefrom;
3. No matter the objective article is being sealed or opened, proper tools should be utilized, therefore, it is inconvenient to a bare hands person to accomplish it;
4. The special official mark is pressed or casted on the lead piece, apparently it can not be made more delicately, this gives the unauthorized person a chance to counterfeit for abuse.

As to the paper sealing strip method, long paper strips, after they are stamped with special official sealing marks, are utilized to seal an objective article by adhering their respective ends on the said objective article. This method is frequently adopted by the court to seal houses or other properties under law suit cases, since it is used a long time officially, it symbolizes the performance of official power, therefore, it is not popularly adopted by the civilian circle. Furthermore, when the paper sealing strips are torn down from their objective article, their ends will still remain tightly adhered on the objective article which are difficultly to be removed, therefore, when this method is applied to a daily using article, such as the coin collecting box, it not only will be troublesome but also destroy the appearance of the said box.

From the standing point of view of the above said coin collecting box for a bus or similar other articles, it can be see that a simplified and sure sealing means for abuse prevention is required to be deviced.

SUMMARY OF THE INVENTION

The main object of present invention is to provide a sure abuse preventing sealing means, this means can be inscribed with symbols or marks which can not be easily counterfeited, such as a stamp print, a private signature, or a precision printing, when it is used.

Other object of present invention is to provide a sure abuse preventing sealing means as set forth above, in which, both of it's sealing and opening procedures are simplified to be performed without any help of tools.

Still other object of present invention is to provide a sure abuse preventing means as set forth above, in which, it is characterized with a low production cost, it's main component can be repetitively use to reduce application cost, and it is applicable to articles which need frequent sealing and opening.

The sealing means which accomplishes the above said objects, includes: a U-shaped strip piece with toothed-edges, or a straight strip with toothed-edges which can be bent Linto from a U-shoped strip piece, and a sealing block which is provided with two narrow one-way going slits to allow the two ends of the said U-shaped strip piece to be inserted in but locking them up from being pulled out. When this simplified sealing means is applied to an article which needs frequent sealing and opening, such as the coin collecting box for a bus, it is impossible to open the same article except the U-shaped strip piece is destroyed. Further more, the sealing block still remains in perfect condition even if the U-shaped strip piece is destroyed, therefore, it can be repetitively used to save application cost.

BRIEF DESCRIPTION OF THE DRAWINGS

Further objects and advantages of the invention will be apparent from a reading of the following detailed description, taken in conjunction with the FIGS. of the accompanying drawings, in which.

DETAILED DESCRIPTION OF THE PREFERED EMBODIMENTS

Figure 1:
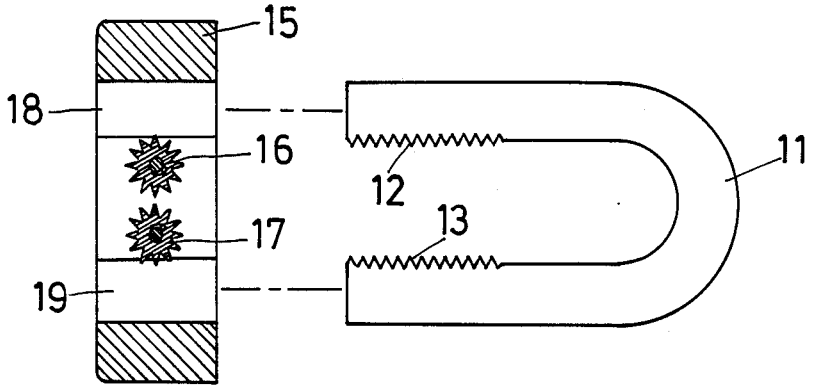
FIG. 1 is the partial cut-away view for embodiment example No. 1 of the present invention, in which, the U-shaped strip piece with toothed-edges and the sealing block are shown.

Please refer to FIG. 1, the sealing strip piece for embodiment example 1 11 of the present invention is a U-shaped piece with toothed-edge 12 and 13; the sealing block for embodiment example 1 15, which incorporates with the sealing strip piece 11, is provided with two one-way rotating gears 16 and 17, and two narrow slits 18 and 19 which allows the two ends of the sealing strip piece to be inserted in.

Figure 2:
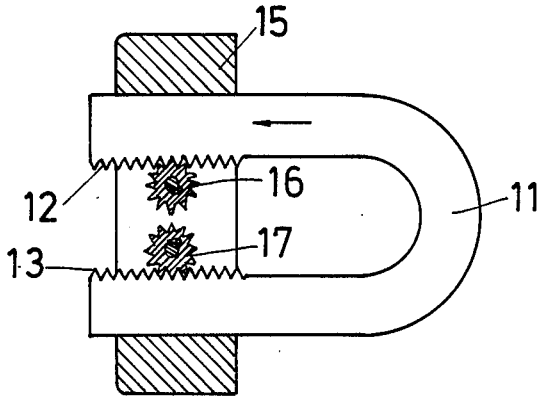
FIG. 2 is the cut away view of the present invention, except that the U-shaped strip piece as shown in FIG. 1, has been inserted into it's sealing block.
Figure 3:
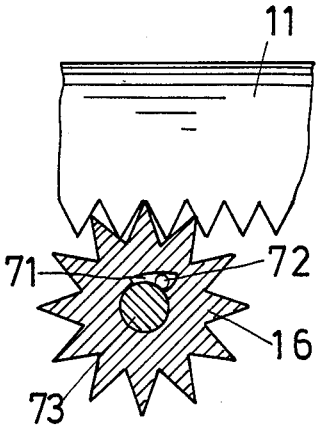
FIG. 3 is the enlarged view of the toothed-edge portion of the U-shaped strip piece which engages on the one-way rotating gear of the sealing block as shown in FIG. 2.

Please refer to FIG. 2 and 3, it can be seen that the inner part of the gear 16 is provided with a slot 71 having different width at it's respective ends, inside this slot 71 it is provided with a free rotating roller 72. Therefore, when the a free rotating roller 72. Therefore, when the user inserts the two leg portion of the U-shaped sealing strip 11 into the narrow slits 18 and 19 of the sealing blocking 15, the two toothed edges 12 and 13 of the sealing strip piece 11 will be engaged on the two one-way rotating gears 16 and 17 meanwhile push them to rotate; the rotating direction of gear 16, at this time, is along arrowhead a which causes roller 72 to move and rotate toward the wider end of slot 71, in this manner, the gear 16 rotates freely. Afterward, if the user tries to pull this sealing strip piece 11 out in the reverse direction, at this time, the roller 72 will move and rotate toward the narrower end of the slot 71, in this manner, the roller 72 will be clamped tightly inbetween the two walls of the fixed axle 73 and the gear 16, which stops the reversal movement of the gear 16 and the sealing strip piece 11 from to be pulling out. The same thing is true for another gear 17, i.e. the sealing block 15 only allows the sealing strip piece 11 to be inserted in and clamping it from to be pulling out in the reverse direction.

Figure 4:
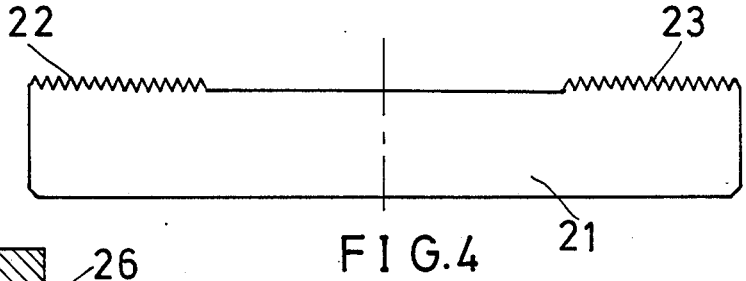
FIG. 4 is the plane view for the sealing strip piece with toothed-edge (embodiment example 2) of the present invention.

Please refer to FIG. 4, it can be seen that the embodiment example 2 for the sealing strip piece of the present invention is a straight strip 21 with toothed edges 22 and 23 on both end portion.

Figure 5:
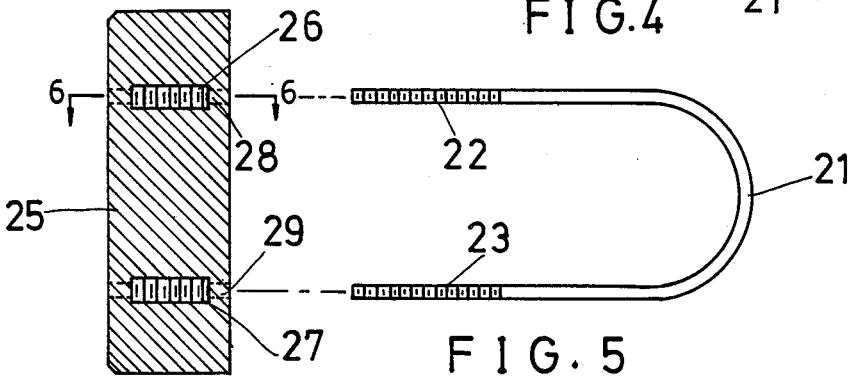
FIG. 5 is the top view of the sealing strip piece shown in FIG. 4, except it has been bent into a U-shaped form, in this FIG., the sealing block is shown in cutaway view.
Figure 6:
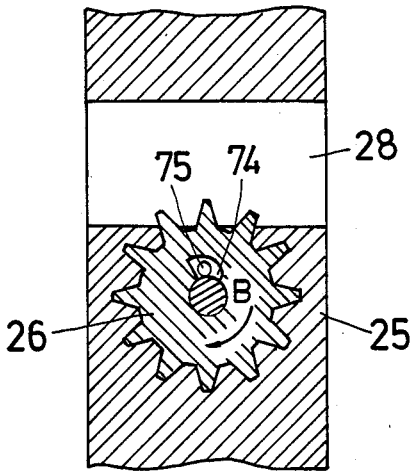
FIG. 6 is the cutaway view along line 6—6 of FIG. 5, which illustrates the structural detail of it's one-way rotating gear.

Please refer to FIGS. 5 and 6, it can be seen that the inner portion of the sealing block 25, which is used with the sealing strip piece 21 of embodiment example 2, is also provided with two one-way rotating gears 26 and 27 in addition to it's two narrow slits 28 and 29 for inserting in the respective ends for the sealing strip piece 21, but the relative positions of the narrow slits to the one-way rotating gears are quite different from embodiment example. Furthermore, the inner part of the two one-way rotating gears are provided with respective slot 74 having different width at each end, also inside each slot 70 it is provided with respective free moving and rotating roller 75 for furnishing the gears 26 and 27 with braking function, in this manner, gear 26 and 27 can be rotated only along the direction as indicated by arrowhead B. Therefore, after the sealing strip piece 21 is bent into a U-shaped form and inserted it's two end portion into the two slits 28 and 29 of the sealing block 25, it no more can be pulled out in the reverse direction due to the braking action of the gear and roller assemblies.

Figure 7:
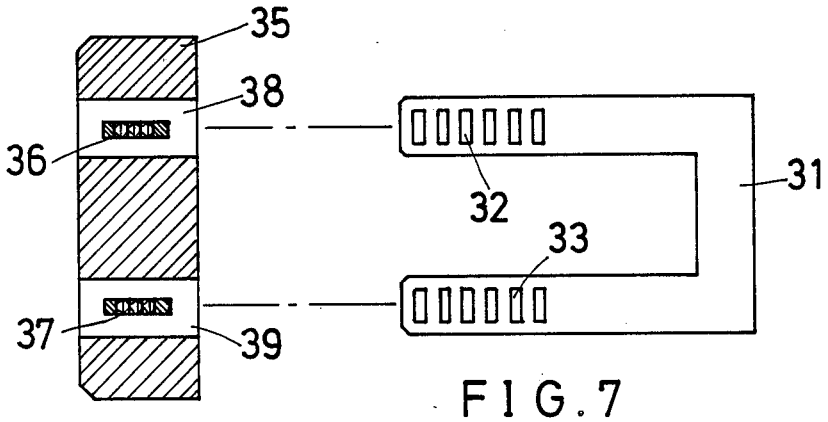
FIG. 7 is the partial cutaway view for the embodiment example 3 of the present invention, which illustrates the central part of the two legs of the U-shaped sealing strip piece are provided with slots.

Please refer to FIG. 7 , it can be seen that the sealing strip piece 31 of the embodiment example 3 of the present invention is constructed into a U-shaped form, on the central portions of it's two legs are provided with consecutive slots 32 and 33; the inner portion for the sealing block 35 of the embodiment example 3 of the present invention is provided with two one-way rotating gears 36 and 37 in addition to it's narrow slits 38 and 39 for inserting in the two legs of the sealing strip piece 31.

Figure 8:
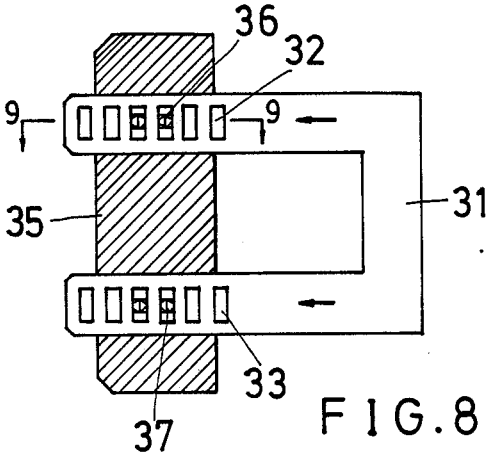
FIG. 8 is the cutaway view for the embodiment example 3 of the present invention, except it's U-shaped sealing strip piece, has been inserted in and engaged with it's sealing block.
Figure 9:
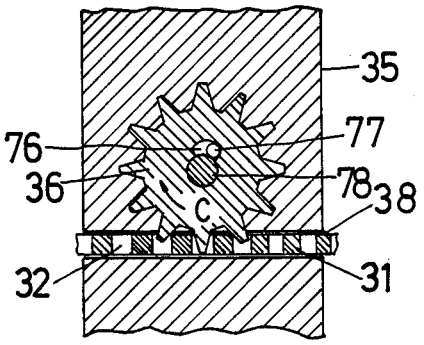
FIG. 9 is the cutaway view along line 9—9 of FIG. 8.

Please refer to FIG. 8 and 9, it can be seen that the inner part of the gears 36 and 37 are provided with respective slots 76 having different width on each end, inside this slots 76 they are provided with respective free moving and rotating roller 77, therefore, when the two legs of the U-shaped sealing strip piece 31 is inserted into the two narrow slits 38 and 39 of the sealing block 35, the consecutive slots 32 and 33 on each leg of the sealing strip piece 31 will be engaged into the teeth of the one-way rotating gears 36 and 37 and drive them to rotate; in which, gear 36 rotates in the direction as shown by arrowhead C, it pushes the roller 77 to move and rotate freely toward the wider end of the slot 76, in this manner, no braking function will be developed to stop the rotation of the gear 36, afterward, if the user tries to pull the sealing strip piece 31 out in the reverse direction, at this time, the roller 77 will be driven to move toward the narrower end of the slot 76 and consequently it is clamped tightly inbetween the two walls of the fixed axle 78 and gear 36, braking function is thence developed on the gear 36 to stop its rotational movement which in turn prevents the sealing strip piece 31 from pulling out in the revesal direction. Another gear 37 is also provided with the same braking mechanism for preventing the another leg of the same sealing strip piece 31 from pulled out in the reversal direction.

Figure 10:
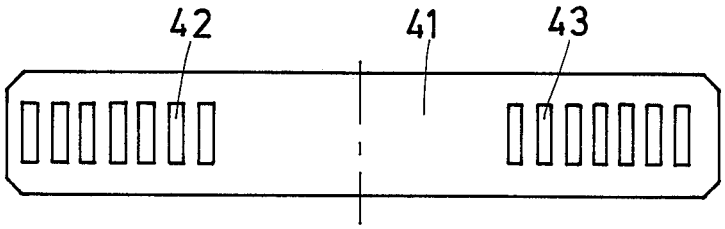
FIG. 10 is the plane view of the sealing strip piece for embodiment example 4 of the present invention, which illustrates the central part of it's two end portions are provided with slots.

Please refer to FIG. 10, it can be seen that the sealing strip piece 41 for embodiment example 4 of present invention is a straight strip having consecutive slots 42 and 43 respectively on central portion near it's two ends.

Figure 11:
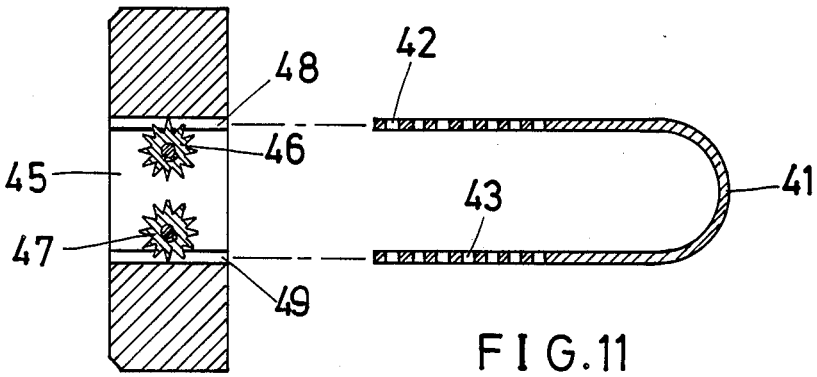
FIG. 11 is the cut away view for the sealing strip piece, as shown in FIG. 10 (embodiment example 4), and it's sealing block, except the sealing strip piece has been bent into a U-shaped form.
Figure 12:
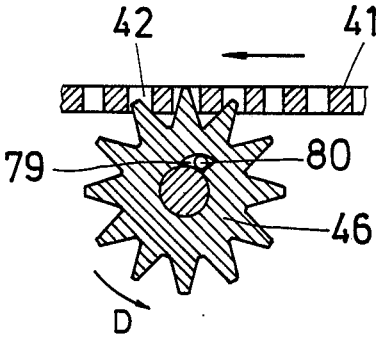
FIG. 12 is the enlarged view of the sealing strip piece, as shown in FIG. 11, which engages with it sealing block.
Figure 13:
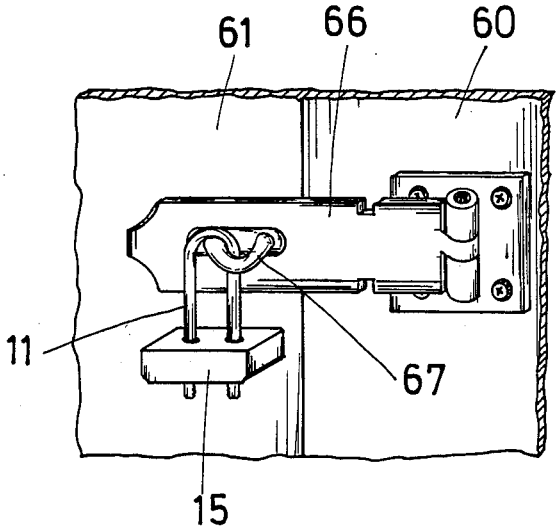
FIG. 13, 14, 15, and 16 are the perspective views showing various embodiments of the present invention as they are applied to seal same article.
Figure 14:
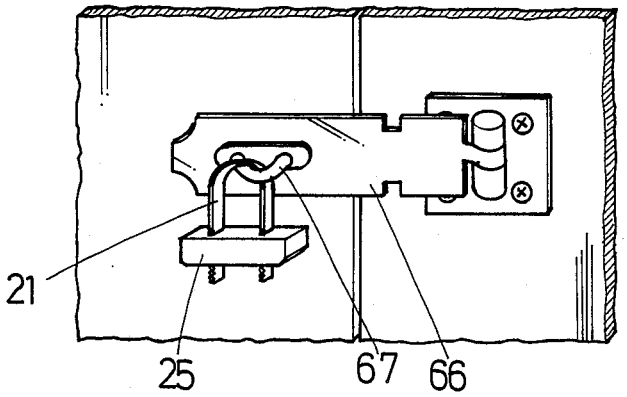
Figure 15:
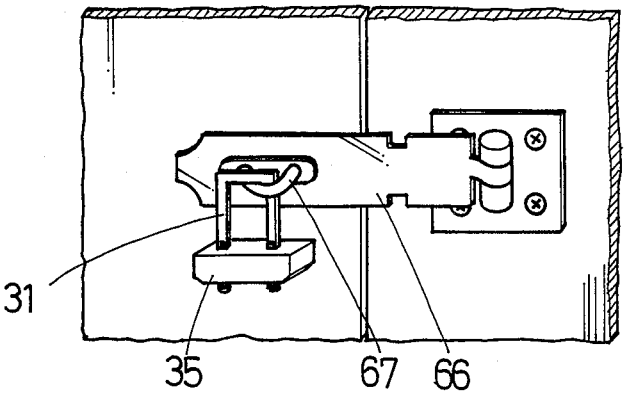
Figure 16:
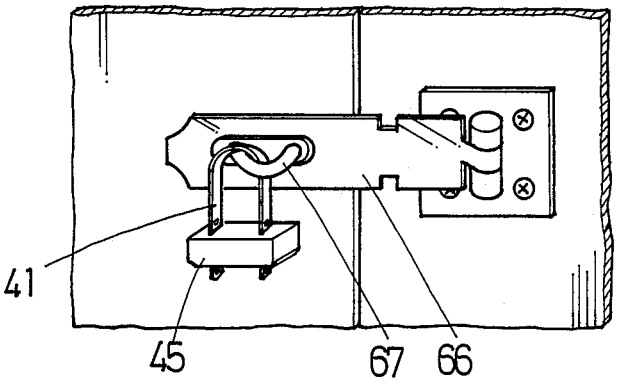

Please refer to FIGS. 11 and 12, it can be seen that the inner portion of the locking block 45 for embodiment example 4, which is used together with the sealing strip piece 41 for embodiment example 4 of the present invention, is also provided with two one-way rotating gears 46 and 47 in addition to it's narrow slits 48 and 49 except the relative positions of the two slits with respect to the two one-way rotating gears are quite different from embodiment example 3. The inner part of these one-way rotating gears 46 and 47 are also provided with respective slots 79 having one end wider than the other's, inside these slots, then are provided with respective free moving and rotating rollers 80 or furnishing braking function to their respective gears 46 and 47, in this manner, gears 46 and 47 can be rotated only in the direction as indicated by the arrowhead D. Therefore, when the user inserts the two legs of the sealing strip piece 41, after it is bent into a U-shaped form, into the two narrow slits 48 and 49 of the sealing block 45, it no more can be pulled out in the reversal direction due to the braking function developed inbetween the two walls of the fixed axles and the slots 79 of the gears 46 and 47 by the rollers 80.

Please refer to FIGS. 13, 14, 15 and 16, they are perspective views showing how various embodiment examples of the present invention are applied to seal the same article. For simplicity, let us take the coin collecting box for a bus as an example for explaination, the lower part of a coin collecting box 60 is provided with a detachable coin storage container 61 to store the collected coins, on the main body of this coin collecting box 60 it is provided with a hinged plate 66, on the coin storage container 61 it is provided with a ring piece 67, and the hinged plate 66 is used to link the ring piece 67. Before the bus is going to have a business running, the first thing a person who is responsible for coin collection should do is to link the hinged plate 66 to the ring piece 67, then passes through one leg of the U-shaped sealing strip piece 11, 21, 31, or 41 into the ring piece 67 just over the outer surface of the linked hinged plate 66, finally inserts the two legs of the U-shaped sealing strip piece 11, 21, 31, or 41 into the respective narrow slits of the sealing block 15, 25, 35, or 45; since this sealing measure only allows it's sealing strip piece to be inserted in and blocks it from pulled out, therefore, the sealing purpose is thus served, under this condition, unless the sealing strip piece is destroyed, the coin storage container can not be opened or drawn out. After the business running of the bus is finished and returns to its main station, the first thing, a person who is responsible for coin collection should do, is to cut off the U-shaped sealing strip piece 11, 21, 31, or 41, open out the coin storage container 61, and take all the coins out; at this time, the remain portions of the sealing strip piece staying inside the narrow slits of the sealing block are straight pieces, therefore, they can be easily pulled out from the other side of the sealing block. When the same bus starts for it's next business running, the person who is responsible for the coin collection can use the same sealing block and a new sealing strip piece to reseal the same coin collecting box, of course, the sealing strip pieces can be marked with signatures, symboles, or words which can not be easily counterfeited for abuse prevention; since the sealing block can be repetitively used, only the sealing strip pieces are expendable, furthermore, the sealing strip pieces can be made of paper boards, steel sheets, or other materials, thus it's application cost can greatly reduced. Since the sealing strip pieces of the present invention can be made of paper boards, because paper boards possess superior ink adherence properties, consequently, precision prints, stamps, and signatures, which are not easily counterfeited, can be made on it for abuse prevention, apparently, the present invention possesses much better advantages over the traditional lead seal method in the sense of abuse prevention.

When present invention is used to seal an article, the procedures for sealing and reopening of the same article are very simple and a simple tool or even no tool is required for performing them, therefore it is convenient and time saving as compared to the traditional lead seal method.

As indicated, the structure herein may be variously embodied. Recognizing various modifications will be apparent, the scope hereof shall be deemed to be defined by the claims as set forth below.

What is claimed is:

1. A simplified abuse preventing sealing device, which comprises of a U-shaped sealing strip piece, such as a straight sealing strip piece bent into a U-shaped form, and a sealing block which allows the two legs of the said U-shaped sealing strip piece to be inserted in but brakes or stops them from to be pulled out in the reversal direction; the inner portion of the said sealing block is provided with gears, and the inner part of each said gear is provided with a slot having different width at it's two ends, inside each said slot it is provided with a free moving and rotating roller which furnishes braking or stopping function to the said gears for preventing them from rotation in the reversal direction, consequently, it makes each of the said gears to become a one-way rotating component; the U-shaped sealing strip piece is provided with toothed edges, or rows of consecutive slots, when the two legs of the said sealing strip piece is inserted into the said sealing block, the teeth or the slots on the leg portion of the sealing strip piece will engaged respectively on the teeth of the said gears of the sealing block and drive the respective gears to rotate; thereafter, if someone is trying to pull the said sealing strip piece out in the reversal direction, each of the said rollers will be clamped tightly inbetween it's respective walls inbetween the slot of the said gear and the fixed axle, consequently, braking or stopping function is thus developed on the said gears for preventing the said U-shaped sealing strip piece from to be pulled our in the reversal direction.

* * * * *